US006978850B2

(12) United States Patent
Sawyer

(10) Patent No.: US 6,978,850 B2
(45) Date of Patent: Dec. 27, 2005

(54) SMART CLUTCH

(76) Inventor: Donald M. Sawyer, 38 La Costa Dr., Montgomery, TX (US) 77356

( * ) Notice: Subject to any disclaimer, the term of this patent is extended or adjusted under 35 U.S.C. 154(b) by 71 days.

(21) Appl. No.: 10/640,808

(22) Filed: Aug. 14, 2003

(65) Prior Publication Data

US 2005/0034895 A1 Feb. 17, 2005

(51) Int. Cl.[7] ..... E21B 7/06
(52) U.S. Cl. ..... 175/61; 175/75
(58) Field of Search ..... 175/61, 73, 74, 175/75, 76, 320, 40, 45, 250

(56) References Cited

U.S. PATENT DOCUMENTS 4,009,613 A * 3/1977 Jeter ..... 367/85
5,213,168 A * 5/1993 Warren et al. ..... 175/61
5,484,029 A * 1/1996 Eddison ..... 175/73

* cited by examiner

*Primary Examiner*—Frank S. Tsay
(74) *Attorney, Agent, or Firm*—Osha Liang LLP

(57) ABSTRACT

In one embodiment, a directional apparatus is disclosed for orienting and maintaining a desired orientation of a drill bit, which will be attachable to a drill string and include an asymmetrically weighted outer sleeve that is susceptible to the earth's gravity in such fashion that the side of the sleeve having a higher specific gravity will be "down" when the directional apparatus is in a segment of non-vertical well-bore. A clutch is included for transmitting a desired amount of rotational energy from a rotating drill string to a drill assembly containing the drill bit. Sensors in the sleeve and/or other elements of the apparatus detect the orientation, which may be stored in memory. The apparatus may also include one or more anti-rotational elements.

16 Claims, 6 Drawing Sheets

SMART CLUTCH

BACKGROUND OF INVENTION

1. Field of the Invention

The invention relates generally to a tool for directional drilling of a wellbore. More specifically, this invention relates to a smart clutch for transmitting a desired degree of rotational energy from a drill string to a directional assembly.

2. Background Art

Directional drilling involves varying or controlling the direction of a wellbore as it is being drilled. Usually the goal of directional drilling is to reach or maintain a position within a target subterranean destination or formation with the drilling string. For instance, the drilling direction may be controlled to direct the wellbore towards a desired target destination, to control the wellbore horizontally to maintain it within a desired payzone or to correct for unwanted or undesired deviations from a desired or predetermined path.

Thus, directional drilling may be defined as deflection of a wellbore along a predetermined or desired path in order to reach or intersect with, or to maintain a position within, a specific subterranean formation or target. The predetermined path typically includes a point where initial deflection occurs and a schedule of desired deviation angles and directions over the remainder of the wellbore. Thus, deflection is a change in the direction of the wellbore from the current wellbore path.

It is often necessary to adjust the direction of the wellbore frequently during directional drilling, either to accommodate a planned change in direction or to compensate for unintended or unwanted deflection of the wellbore. Unwanted deflection may result from a variety of factors, including the characteristics of the formation being drilled, the makeup of the bottomhole drilling assembly and the manner in which the wellbore is being drilled.

Deflection may be measured as an amount of deviation of the wellbore from the current wellbore path and expressed as a deviation angle or hole angle. Commonly, the initial wellbore path is in a vertical direction. Thus, initial deflection often signifies a point at which the wellbore has deflected off vertical. As a result, deviation is commonly expressed as an angle in degrees from the vertical.

Various tools and techniques may be used for directional drilling. First, the drill bit may be rotated by a downhole motor which is powered by the circulation of drilling fluid ("mud") supplied from the surface and converts the flow into rotational energy, the mud flow otherwise being used to cool the drill bit and lift drill cuttings out of the wellbore. Such motors are often used in a technique, sometimes called "slide drilling", that is typically used in directional drilling to effect a change in direction of the wellbore, such as the building of an angle of deflection.

Current technology normally employs steerable motors, wherein a combination of rotary and slide drilling to be performed. Rotary drilling will typically be performed until such time that a variation or change in the direction of the wellbore is desired. The rotation of the drilling string is typically stopped and slide drilling, employing the bend in the downhole motor, is commenced. Although the use of a combination of slide and rotary drilling may permit satisfactory control over the direction of the wellbore, problems and disadvantages associated with slide drilling are still encountered. Because the drilling string is not rotated during slide drilling, it is therefore prone to sticking in the wellbore, particularly as the angle of deflection of the wellbore from the vertical increases, resulting in reduced rates of penetration of the drilling bit.

With each of the aforementioned techniques, orientation of the motor housing can often be difficult to maintain, because as the drill bit contacts the earth formations to drill them, a reactive torque is generated against the motor housing which changes the orientation.

More recently, rotary steerable systems have been developed for connection in the bottom hole assembly of a drill string which comprise a number of hydraulic actuators spaced apart around the periphery of the unit. Each of the actuators has a moveable thrust member or pad which is hydraulically displaceable outwardly for engagement with the formation of the borehole being drilled. The rotary steerable system also includes a selector apparatus which, when actuated, causes each of the moveable thrust members to be displaced outwardly at the same selective rotational position, which biases the drill bit laterally and thus controls the direction of drilling.

A more recently developed rotary steerable system, disclosed in U.S. Pat. No. 6,216,802, issued to Donald M. Sawyer, utilizes an asymmetrically weighted collar ("AWC") to maintain a desired orientation of a drilling assembly. In this type of system, a first and second driveshaft are coupled within the housing of the directional drilling apparatus.

FIG. 1 shows one embodiment of a prior art rotary steerable system as it is used to directionally drill a wellbore through earth formations. The wellbore 2 is shown as has been drilled through the earth formations 4. The wellbore 2 can be drilled using a rotary drill bit 30 of any type known in the art.

As is well known in the art, rotary power to turn the drill bit 30 can be provided by a drilling rig (not shown) or the like located on the earth's surface. The drilling rig is typically coupled to the drill bit 30 by a drilling assembly which includes sections of threaded drill pipe, one section of which is shown at 6. As is also well known in the art, the drill pipe 6 can include, generally at the bottom end, larger diameter, high-density sections known as "heavy-weights" or "drill collars" which increase the bottom-end weight of the drilling assembly so that earth's gravity can assist in providing axial force to the drill bit 30. A drilling assembly which includes only drill pipe 6, collars, the bit 30, and centering tools known as stabilizers, shown generally at 8 and 28, will follow a trajectory affected by gravity, the flexibility of the drilling assembly and the mechanical properties of the earth formations 4 through which the well is drilled. The rotational axis (not shown) of the drill bit 30 in such drilling assemblies is substantially coaxial with the center line 10 of the drilling assembly, not taking account of any flexibility of the drilling assembly.

Directional drilling systems, such as described herein, cause the rotational axis (not shown) of the drill bit 30 to be deflected from the center line (rotational axis) 10 of the drill pipe 6 in a selected direction. Thus, a prior art rotary steerable system, shown generally at 32 and for convenience referred to hereafter as a "steering system", provides a mechanism to place the axis of rotation of the drill bit 30 along such a selected direction.

The principal components of the steering system 32 may include an orientation collar, shown as 16 in FIG. 1. The purpose of the orientation collar 16 is to provide a rotationally fixed reference against which to set an axis of rotation of the drill bit 30, as will be further explained. In this embodiment, the orientation collar 16 is an AWC, which includes bearings 12, 18 and 20 to enable free rotation, within the orientation collar 16, of an upper driveshaft 14 and a lower driveshaft 24. As will be further explained, the orientation collar 16 is asymmetric in mass radially or circumferentially about its axis (that is, it is rotationally unbalanced) so that one side of the orientation collar 16 will tend to rest downwardly, that is, in the direction of gravity. The asymmetry of the mass of the orientation collar 16 in this embodiment provides one element of the steering system 32 which is substantially rotationally fixed during drilling.

Rotary torque can be transmitted from the drilling rig (not shown) at the earth's surface directly to the bit 30 through the steering system 32. The upper driveshaft 14 is coupled at one end to the drill pipe 6. The upper driveshaft 14 can be flexibly coupled to the lower driveshaft 24 by means of a universal joint, flexible coupling, constant velocity joint or any similar flexible rotary connection, shown generally at 22, which enables transmission of rotary torque across a change in direction of the axis of rotation. The upper driveshaft 14 rotates substantially collinearly with the drill pipe 6 immediately connected thereto because it is held in position relative to the collar 16. The lower driveshaft 24 can be coupled through lower stabilizer 28 to the bit 30, through a mud motor (not shown) or any other drilling tools.

In the steering system 32, the orientation of the axis of rotation of the lower driveshaft 24 with respect to the center line 10 of the orientation collar 16 is generally changed by changing the position of the center of the lower bearing 20 with respect to the center line 10 of the orientation collar 16. The orientation of the axis of rotation of the lower driveshaft 24 will thus be determined by the relative position of the lower bearing 20 with respect to the center line 10 of the orientation collar 16.

With respect to the example shown in FIG. 1, while the adjuster for setting the position of the lower bearing 20 is fixed, in another aspect of the steering system 32, an adjuster which can be operated while the steering system 32 is in the wellbore 2 can also be used. Mechanisms for translating and rotating the sliding sleeve with respect to the collar 16 are known in the art. Gears, hydraulic actuation or other means may be used.

Adjustments to orientation can be configured using control circuits well known in the art, to be responsive to measurements from a measurement-while-drilling (MWD) system (not shown) forming part of the drilling assembly, or to be responsive to drilling mud pressure-based command signals sent from the earth's surface. Such remotely operable adjusters make possible both wellbore trajectory adjustments during drilling, and trajectory maintenance settings where the center of rotation of the lower bearing 20 is set to be axially parallel with the center line 10 of the orientation collar 16, so that the extant trajectory of the wellbore 2 will be maintained.

The orientation collar 16 and components running through it are shown in more detail in FIGS. 2 and 3. In FIG. 2, the collar 16 can include a case 16A which can be a steel pipe or the like preferably being cylindrically shaped and having an outside diameter comparable to that of the drill pipe (6 in FIG. 1), connected to the upper driveshaft 14. For example, if the portion of the drill pipe (6 in FIG. 1) connected to the upper driveshaft is a 6.75 inch (171.45 mm) O.D. "heavy weight" or "drill collar", then the case 16A preferably has the same 6.75 inch (171.45 mm) outside diameter to maintain overall stability of the drilling assembly. The upper driveshaft 14, as well as the lower driveshaft 24 typically include a centrally located passage or bore 14A through which the drilling mud can flow.

The inner diameter of the case 16A, although its actual dimension is not critical, should preferably be selected to provide a space 14B for the bearings 12, 18, 20 between the inner diameter of the case 16A and the outer diameter of the driveshafts 14, 24. The inner diameter of the case 16A should also be as small as is practical, as should be the outside diameter of the driveshafts 14, 24, to enable the mass of the collar 16 to be as large, and as asymmetric about the axis of rotation as possible, consistent with the need for adequate bending stiffness of the driveshafts 14, 24 and of the overall drilling assembly, and consistent with the driveshafts 14, 24 having the capacity to transmit adequate rotary torque to the bit (30 in FIG. 1) without breaking.

The case 16A includes therein a high specific gravity section, shown generally at 16B. The high specific gravity section 16B is shown as subtending about half the total circumference of the case 16A, but it should be understood that the amount of the circumference subtended by the high specific gravity section 16B is a matter of convenience for the system designer. The actual shape of the high specific gravity section 16B is also a matter of convenience. A cross-section of the collar 16, including the case 16A, the high specific gravity section 16B and a corresponding low specific gravity section 16C, is shown in FIG. 3. The high specific gravity section 16B can be formed, for example, by filling the part of the case 16A with very dense materials such as lead, depleted uranium or the like. The low specific gravity section 16C may be merely enclosed air space, but preferably includes filling that portion of the case 16A with a low density, relatively incompressible material, such as oil or aluminum for example, so that the case 16A will resist crushing under hydrostatic pressure in the passage 14A and in the wellbore (4 in FIG. 1). The high specific gravity section 16B will tend to rest in the direction of gravity, providing a rotationally fixed reference against which to set the position of the lower bearing 20 with respect to the center of the collar 16. As previously explained, setting the position of the center of the lower bearing 20 at a known location from the center of the orientation collar 16 provides an axis of rotation for the lower driveshaft 24 which is different from the axis of rotation of the upper driveshaft 14 and which is oriented in a known, selected direction with respect to the known rotational reference, i.e. earth's gravity.

Additional features which may reduce the tendency of the orientation collar 16 to be rotated by friction between the driveshafts (14, 24 in FIG. 1) and the collar 16 are shown in FIG. 4. In one such improvement, the low specific gravity section 16C, which may be filled with a solid such as aluminum, for example, can include spiral passages 17 therethrough that can be hydraulically connected to the passage (14B in FIG. 2). Fluid inertia of the mud flowing in the spiral passages 17 can reduce the tendency of the orientation collar 16 to rotate away from its gravitational orientation.

Another such improvement includes helically spaced-apart vanes or fins 19 disposed on the exterior of the case 16A so that fluid flow up the annulus (2 in FIG. 1) will tend to stabilize the rotational position of the collar 16.

Still another improvement may comprise jets 21 formed through the collar 16 which interconnect the passage (14B in FIG. 2) and the annulus (4 in FIG. 1) and which have a discharge direction such that drilling mud discharged through the jets 21 will create a thrust tending to oppose fluid-friction induced rotation of the collar 16 in the direction of rotation 23 of the drill pipe (6 in FIG. 1).

Still another example of an improvement to the case 16A used to resist rotation of the case 16A while drilling is shown in FIG. 5. The case 16A includes in the heavy weight section 16B a sprag 19A which can be extended by gravity so that friction teeth 21 disposed on the outside of the sprag 19A can contact the wall of the wellbore. Lateral movement of the sprag 19A can be limited by pins 23 that are disposed in cavities 25 and mesh in mating slots 27 in the sprag 19A. The sprag 19A shown in this example is actuated by gravity, but it should be clear to those skilled in the art that powered forms of actuation for the sprag 19A, such as hydraulic cylinders, solenoids, springs or the like can also be used to extend the sprag 19A laterally from the case 16A.

The preceding embodiments of the orientation collar 16 rely on earth's gravity to orient the collar 16. As previously explained, the orientation of the collar 16 is used as a fixed reference against which to set the position of the bearing supporting the lower driveshaft (20 in FIG. 1). By setting the position of the lower bearing 20 with respect to the collar 16, the magnitude and direction of the angle of the second driveshaft can be set with respect to the center line of the collar 16. In one embodiment of the collar 16, the collar 16 need not include asymmetric mass but can have its relative orientation determined by means other than earth's gravity.

FIG. 6 shows one embodiment of a prior art anti-rotational element. This embodiment includes a cylindrical housing 52 including fingers 54 attached by a hinge 56, or similar apparatus, so that the fingers 54 may extend radially from the housing 52 in one direction. The extension of the fingers 54 from their retracted state (not shown) may be facilitated by the rotation of the housing 52 in a particular direction so that centrifugal force may cause extension, leading to contact of the fingers 54 with the wellbore 2. The housing 52 also includes An opening 50 for the passage of fluids, once the housing 52 is included as a component of a drilling system. Contact of the fingers 54 with the wellbore 2 will prevent and/or retard rotation of the housing 52 as well as any attached components of the drilling system, in a particular direction, depending on the orientation of the housing in the drilling system. This and other anti-rotational elements are disclosed in U.S. Pat. No. 6,273,190, issued to Donald M. Sawyer, and hereby incorporated by reference.

Although AWCs, as described above, are effective mechanisms for orienting a directional drilling device, their use need not be limited to rotary steerable devices. Accordingly, there exists a need for a directional drilling system that relies on proven technologies while maintaining a desired control of the wellbore trajectory using an AWC. Furthermore, there exists a need for a directional drilling system that is able to compensate for the reactive torque encountered during drilling, thereby maintaining a desired trajectory of the drill string.

SUMMARY OF INVENTION

In one embodiment, a device is disclosed in which a clutch is used to transmit a desired degree of rotational energy from a drill string to a drill assembly, in order to achieve and/or maintain a desired orientation of the drill assembly and drill bit disposed thereupon.

In one embodiment, an orientation device is disclosed in which an asymmetrically weighted sleeve is reversibly connected to a drill assembly in order to maintain a desired orientation of the drill assembly.

In one embodiment, sensors are disposed on one or both of an asymmetrically weighted outer sleeve and a drill assembly of an orientation device, such that the relative rotational orientations of the drill assembly and asymmetrically weighted outer sleeve may be determined.

In one embodiment, a method is disclosed for orienting a drill bit. The method comprises determining the orientation of a drill assembly including the drill bit, transmitting rotational energy from a rotating drill string to the drill assembly until a desired orientation is achieved, and reversibly connecting the drill assembly to an asymmetrically weighted outer sleeve, so that the desired orientation is maintained by the relatively fixed position of the asymmetrically weighted outer sleeve, relative to the earth's gravitational field.

Other aspects and advantages of the invention will be apparent from the following description and the appended claims.

DETAILED DESCRIPTION

As will be described in detail, a drill bit orienting apparatus (hereinafter a "smart clutch") as disclosed herein allows for continued rotation of a drill string during "slide" (or oriented) drilling and orientation. Although rotary steerable systems, as described above, allow for similar functionality, the smart clutch permits users to utilize steerable mud motors, turbines, and other downhole apparatus instead of the more expensive rotary steerable systems. One significant advantage of such a smart clutch is the ability to use less expensive, proven technologies, which may be less prone to failure and which may also be more readily available.

Figure 1:
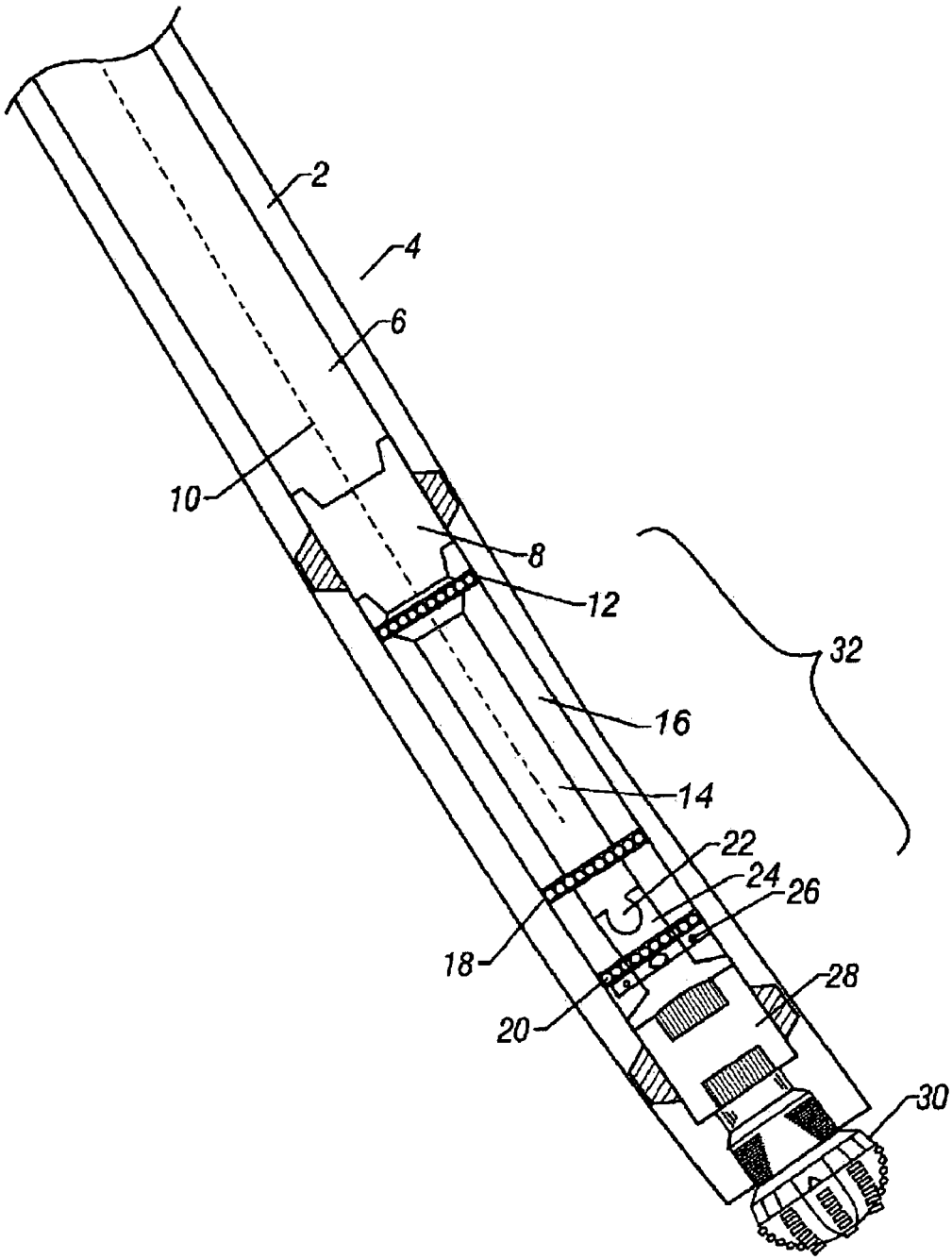
Fig. 1 (prior art)
FIG. 1 shows a prior art rotary steerable system.
Figure 2:
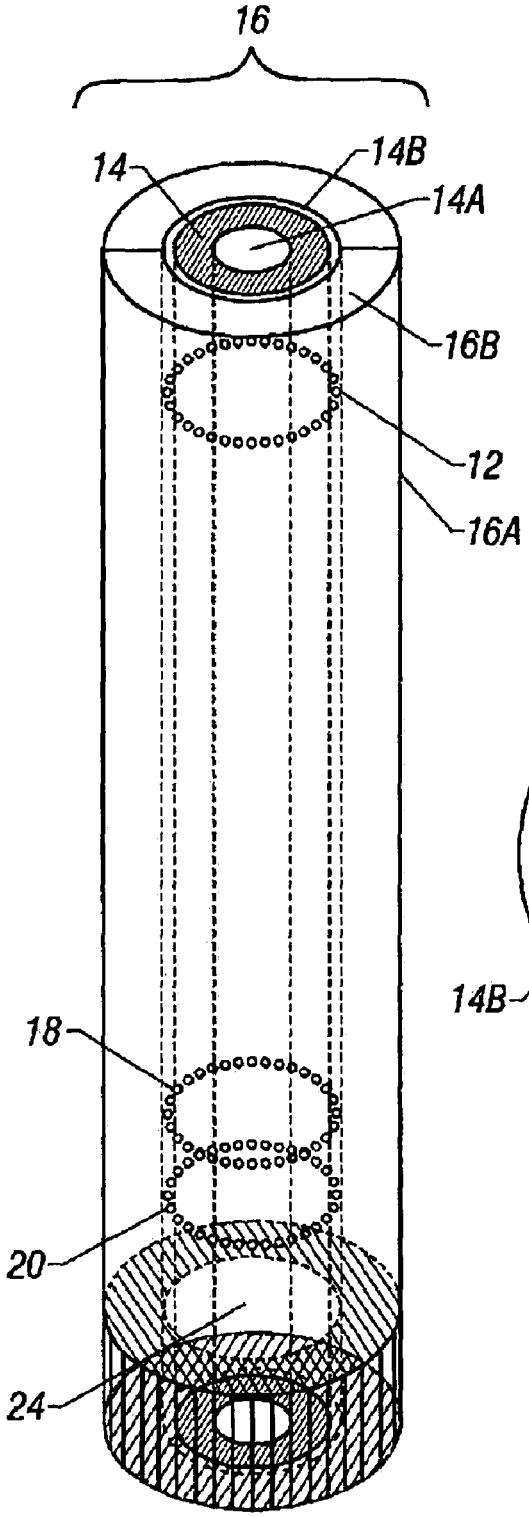
Fig. 2 (prior art)
FIG. 2 shows one embodiment of an orientation collar for a prior art rotary steerable system, which is an asymmetrically weighted collar.
Figure 3:
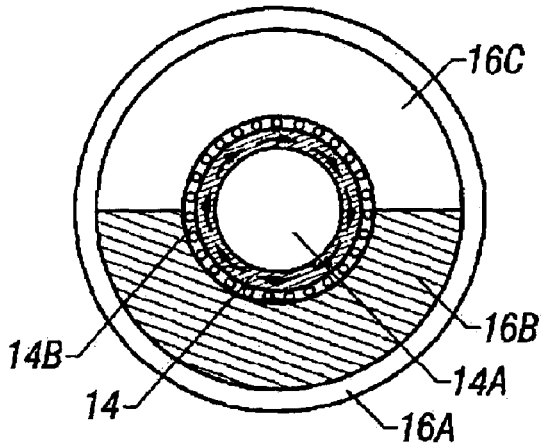
Fig. 3 (prior art)
FIG. 3 shows the embodiment of FIG. 2 in cross-section.
Figure 4:
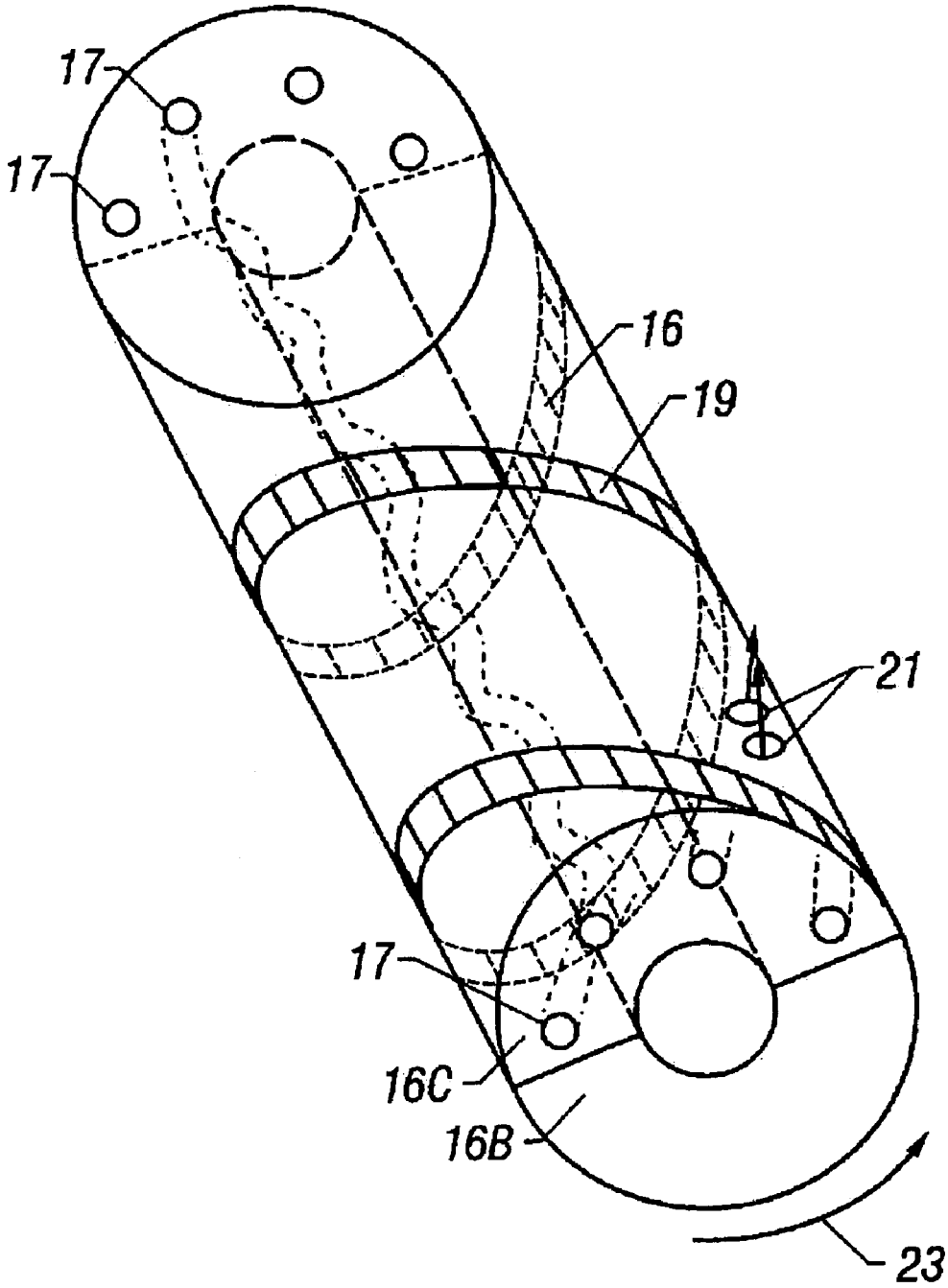
Fig. 4 (prior art)
FIG. 4 shows embodiments of several improvements to the prior art orientation collar of FIG. 2, which reduce the tendency of the asymmetrically weighted collar to rotate as a result of fluid friction between the collar and a driveshaft.
Figure 5:
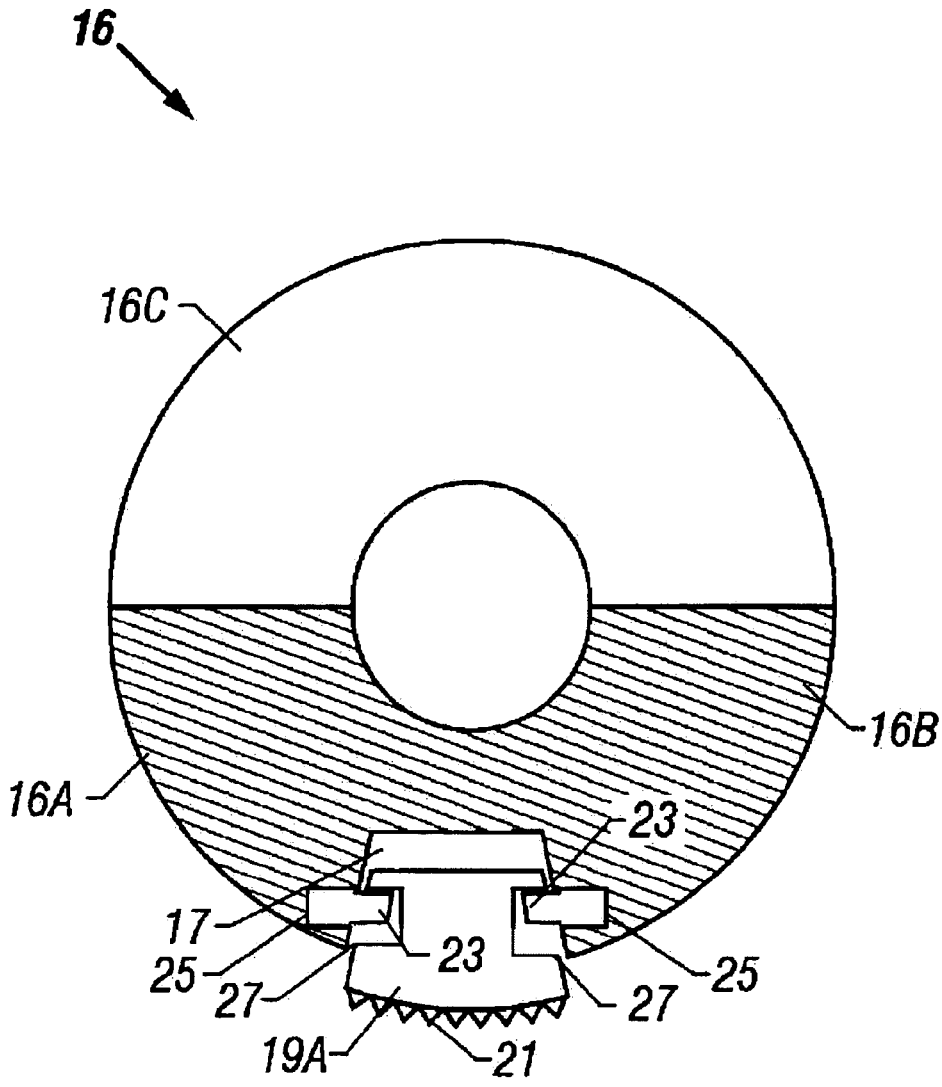
Fig. 5 (prior art)
FIG. 5 shows another embodiment of an improvement used to reduce rotation of the prior art collar.
Figure 6:
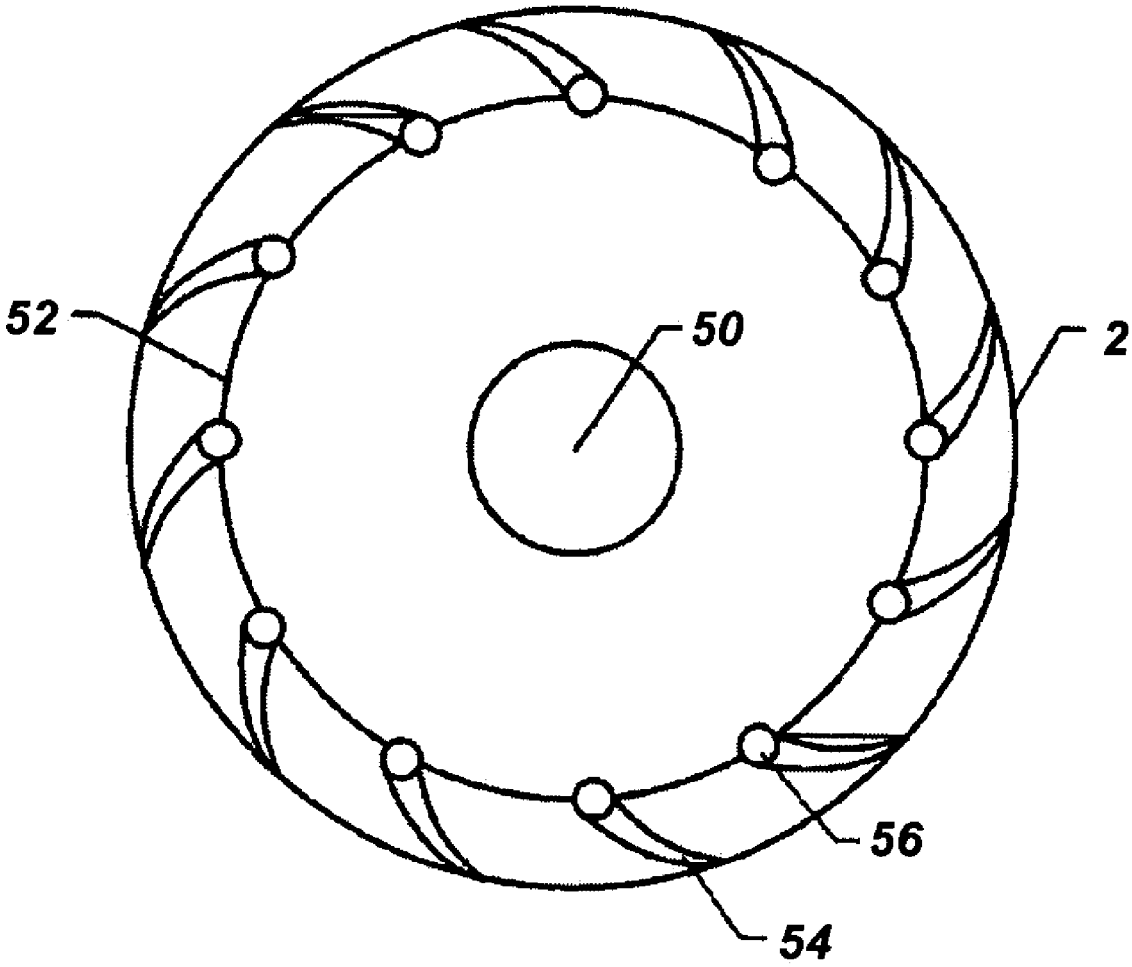
Fig. 6 (prior art)
FIG. 6 shows another embodiment of an improvement used to reduce rotation of the prior art collar.
Figure 7:
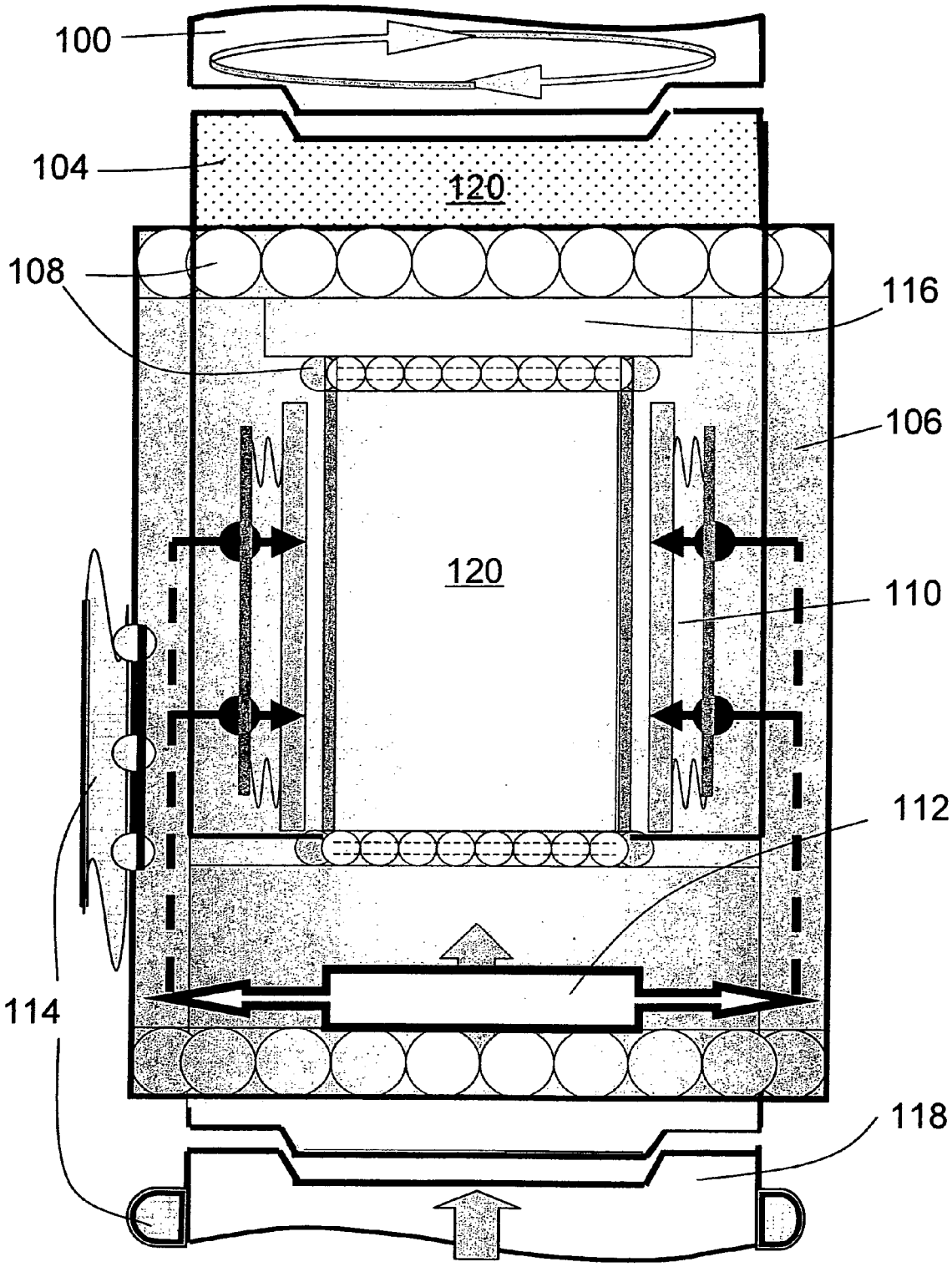
FIG. 7 shows one embodiment of a smart clutch.

FIG. 7 shows one embodiment of a smart clutch for controlling the orientation of a drill bit. A drive shaft 120 comprises an upper drive shaft 104 (nearer the drill string) and lower drive shaft 116 (nearer the bit) and is at least partially contained within a bore of an outer sleeve 106. In one embodiment (not shown), the upper and lower drive shafts 104, 116 will comprise separate members and may be connected by a flexible joint, such as a universal joint, in order to permit a desired degree of axial divergence between the upper and lower drive shafts 104, 116. In one embodiment, the upper drive shaft 104 and lower drive shaft 116 may comprise separate members which are independently rotatable and reversibly engageable to each other by means of splines, or by any other means known in the art.

In one embodiment, an outer sleeve 106 is asymmetrically weighted so that a side of the outer sleeve will have a higher specific gravity with respect to an opposite side ("sides" located with respect to the bore or longitudinal axis of the outer sleeve 106). Thus, the outer sleeve 106 will have rotational and orienting characteristics similar to the AWCs described above. This asymmetrical weight differential will allow for orientation of the outer sleeve 106 with respect to the earth's gravity. Alternatively, other orienting configurations may be used with the outer sleeve 106, which may not rely on earth's gravity.

A drill string 100 is connected to the upper drive shaft 104. The connection of drill string 100 to upper drive shaft 104 may be a fixed connection that does not permit axial variation of the upper drive shaft 104 from the local rotational axis of the drill string 100. Alternatively, the connection of drill string 100 to upper drive shaft 104 may comprise a joint that permits a desired axial divergence from the local rotational axis of the drill string 100. In one embodiment, the drive shaft 120 operates as a rotational element that will convey rotational energy from a rotating drill string 100 to other components of the smart clutch and oriented drilling system, as described in detail below.

The outer sleeve 106 may contain one or more recesses to provide space for bearings 108 and a clutch 110. Alternatively, the upper and lower driveshaft 104, 116 may also contain one or more recesses for bearings, either in addition to, or instead of, any recesses in the outer sleeve 106. The outer sleeve 106 may also include various sensors 112, such as may be used in MWD (measurement while drilling) applications. One or more anti-rotational elements 114 may be located at any point along the outer sleeve 106, and may be of any form known in the art, including, but not limited to, a mechanically, hydraulically, or gravity operated sprag and/or keel. Anti-rotational elements may also be located above and/or below the outer sleeve 106, and may also be included as or upon a separate member. Furthermore, the outer sleeve 106 may include one or more mechanisms for limiting any tendency of the outer sleeve 106 to rotate due to the rotational forces exerted by a rotating drill string 100. The clutch 110 may be located at any point along the outer sleeve 106 or alternatively, may be located at the juncture of the drill assembly 118 and lower drive shaft 116, or at any other point at which it is able to engage a rotating element in order to transfer rotational energy to the drill assembly 118 and/or the outer sleeve 106.

The lower drive shaft 116 is operatively connected to a drill assembly 118. The drill assembly 118 comprises a drill bit (not shown) and may also include one or more mud motors and/or turbines, as well as any other apparatus commonly utilized at the end of a drill string 100. The orientation of the drill bit within the drill assembly 118 may vary from parallel to the longitudinal axis of the drill assembly, to any desired degree of divergence from the longitudinal axis of the drill assembly 118. Furthermore, the orientation of the drill bit within the drill assembly 118 may be controlled so that a desired variance in the angle of the drill bit with regard to the longitudinal axis of the drill assembly 118 may be achieved, either through an input by an operator, through calculations performed by an electronic device, or by any other method known in the art.

The drill assembly 118 may also include one or more orientation markers, so that the orientation of the drill assembly 118 may be determined by orientation sensors, which may be included, in one embodiment, in the outer sleeve 106 or lower drive shaft 116 portions of the smart clutch device. Alternatively, the one or more orientation markers may be disposed in the outer sleeve 106 or lower drive shaft 116 portions of the smart clutch device, while an orientation sensor for detecting the relative position of the marker is disposed in the drill assembly 118. The orientation marker may be of any form known in the art, including but not limited to magnetic, radioactive, and electronic orientation markers. In one embodiment, the orientation sensor will detect the relative rotational position of the orientation marker, with respect to the position of the orientation sensor. Placement of the orientation sensor in the outer sleeve will advantageously provide a relatively stable positioning of the orientation sensor within the wellbore, particularly in non-vertical drilling applications, where the high specific gravity section of the outer sleeve 106 will be a stabilizing factor. Once the relative orientation of the drill assembly 118 and outer sleeve 106 is determined, the amount of rotational force required to achieve and/or maintain a desired orientation of the drill assembly 118 may also be determined.

Alternatively, in one embodiment, the amount of rotational energy required to orient the drill assembly 118 need not be determined in advance. Instead, the clutch 110 may operate first to transmit rotational energy in desired increments, until a desired orientation of the drill assembly 118 is achieved.

The operative connection of the lower drive shaft 116 to the drill assembly 118 allows for a desired degree of rotation of the drill assembly 118 with respect to the lower drive shaft 116. As will be described in greater detail below, the drill assembly 118 will also be operatively connected to the outer sleeve 106 in such a fashion that the outer sleeve 106 may orient at differing degrees of rotation with respect to the drill assembly 118. The drill assembly 118 may also include one or more anti-rotational elements 114, and may also accommodate sensors.

In order to effect a change in the direction of drilling, the drill bit should be diverted from its current path. The smart clutch accomplishes this diversion by transmitting a portion of the rotational energy from the drill string 100 to the drill assembly 118 until the drill assembly 118 reaches a desired orientation. In order to transmit this rotational energy, the clutch 110 can alternate between a contacting position, and non-contacting position with respect to the drive shaft 120. In a contacting position, the clutch 110 transmits rotational energy from the drill string 100 to the drill assembly 118, when the outer sleeve 106 is engaging the drill assembly 118. In one embodiment, the degree of contact between the clutch 110, and a rotational element operatively connected to the drill string 100, may vary in order to achieve a greater control of the transmission of rotational energy from the drill string 100 to the drill assembly 118.

The selective engagement of the clutch 110 with the drill string 100, and outer sleeve 106 with the drill assembly 118, permits a desired orientation of the drill assembly 118 with respect to the outer sleeve 106, thereby facilitating achievement of a desired orientation of the drill bit of the drill assembly 118 with respect to the earth's gravity, as determined by the gravity-induced orientation of the outer sleeve 106. The engagement mechanism of the clutch 110 may be friction-based, or may involve any other form of reversible interaction with a rotatable member.

Because the drill string 100 will typically rotate in only one direction, the outer sleeve 106 will typically be rotatable about the drive shaft 120 in the opposite direction relative to that of the drill string 100. This rotation occurs by releasing the engagement of the clutch 110 with the drive shaft 120, thereby permitting rotation of the drive shaft 120 within the outer sleeve 106. Engagement of the clutch 110 may be continuous, pulsed, or follow any desired pattern as required to transmit a desired degree of rotational energy to the drill assembly 118 in order to achieve or maintain a desired orientation.

In operation, the drill string 100 may continue to rotate as orientation of the drill assembly is adjusted. In one embodiment, the outer sleeve 106, encompassing the clutch 110, will maintain an engaged relationship with the drill assembly 118 as the clutch 110 variably engages the rotating drive shaft 120. Rotational energy from the drive shaft 120 will be transmitted through interaction with the clutch 110, through the outer sleeve 106 and to the drill assembly 118, thereby altering the orientation of the bit. Because the amount of rotational energy is controlled by the interaction of clutch 110 and drive shaft 120, the drill bit may be oriented to any point along the 360 degrees of rotation provided by the drill string 100. Alternatively, rotational energy may be transmitted directly from the drive shaft 120 to the drill assembly 118.

Once a desired orientation is achieved, the drill assembly 118 is reversibly engaged with the outer sleeve 106 which is in a non-rotating state, and therefore will be oriented with the higher specific gravity portion held in a particular position by the earth's gravity. Because the outer sleeve 106 should not ordinarily rotate when not engaged to a rotating element, it will maintain a particular orientation, and through its operative connection with the drill assembly 118, will also maintain the orientation of the drill bit in the desired direction. Once a desired orientation is achieved, a signal may be sent to the smart clutch in order to indicate that the current orientation is to be maintained. In one embodiment, this signal will indicate that one or more current settings, including, but not limited to orientation, are to be stored in some form of memory, in order to facilitate continued drilling along the desired trajectory. Should the outer sleeve 106 deviate from an orientation wherein the high specific gravity section is nearer the gravitational source (e.g., the heavier side is not "down"), in one embodiment a mechanism may be provided to sense such an altered orientation of the outer sleeve 106, and compensate accordingly, in order to achieve and/or maintain a desired orientation of the drill assembly 118. In one embodiment, the drill assembly 118 is rotationally fixed to the drill string 100, during non-oriented rotary drilling.

In one embodiment, the drive shaft 120 may be operatively engageable directly to the drill assembly 118. In such an embodiment, rotation of the drive shaft 120 by the drill string 100 will transmit rotational force to the drill assembly 118, when the drill assembly 118 and drive shaft 120 are operatively engaged. Once the transmitted rotational energy has operated to orient the drill assembly 118 to a desired orientation, the outer sleeve 106 is operatively engaged to the drill assembly 118 to maintain that desired orientation. Prior to or during the operative engagement of the outer sleeve 106 and drill assembly 118, the drive shaft 120 will disengage the drill assembly 118 so that no further rotational energy is transferred, and the desired drill assembly 118 orientation is maintained.

In another embodiment, the drive shaft 120, may be reversibly engageable with the drill string 100. Thus, the drive shaft 120 need not rotate in conjunction with the drill string 100 but instead would selectively engage the drill string 100 such that a desired degree of rotational energy is transmitted to the drive shaft 120. Furthermore, the outer sleeve 106 which is reversibly engageable with the drill assembly 118, may, through selective engagement of the clutch 110, absorb a desired degree of rotational energy from the drive shaft 120. In this fashion, a total of three separate variable engagement mechanisms may operate to transmit a desired rotational energy to the drill assembly 118: (i) drill string 100 to drive shaft 120; (ii) drive shaft 120 to outer sleeve 106; and, (iii) outer sleeve 106 to drill assembly 118. These various engagement mechanisms, which may be operated individually or in any combination, will advantageously provide an increased level of rotational control of the drill assembly 118, thereby facilitating a more precise orientation of the drill bit.

In another embodiment, the upper drive shaft 104 and the lower drive shaft 116 may comprise separate components which may be linked rotationally by the clutch 110 during engagement of the clutch 100 to the drive shaft components.

The selective engagement of one or more engagement mechanisms may be triggered and/or controlled by an operator, or automatically through various electronic components, including, but not limited to, MWD instrumentation. A control signal may be transmitted from the Earth's surface, using any technology known in the art, including mud-pulse telemetry, variation of drill string rotational speed, and variation in mud flow velocity. Furthermore, a particular orientation of the drill assembly 118, with respect to the earth's gravity may also trigger a control signal. The gravitational orientation of the drill assembly 118 may be determined by its relationship to the asymmetrically weighted outer sleeve 106, or by any other means known in the art. Furthermore, the control signal may originate at any point along the drill string or from within the drill assembly 118, or from other instrumentation that is operated down-hole.

In one embodiment the drill assembly 118 will include one or more devices for enabling the determination of orientation of the drill bit. Alternatively, the drill assembly 118 may be configured in such a way that the orientation of the drill assembly 118 may be determined through an evaluation of specific factors, such as non-symmetrical weight distribution or a non-symmetrical physical configuration. Furthermore, the engagement mechanism between the drill assembly 118 and the drive shaft 120 and/or outer sleeve 106 may be configured in a fashion that will allow determination of the relative orientation of drill assembly 118 to drive shaft 120 and/or outer sleeve 106.

Power to the smart clutch system may be provided by any means known in the art, including, but not limited to, hydraulic energy, hydroelectric power, one or more batteries, or a turbine.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for orienting a drill bit, comprising:

an asymmetrically weighted outer sleeve;

a rotational element that is reversibly engageable with the outer sleeve;

a clutch for selectively transmitting a desired degree of rotational energy between the rotational element and the outer sleeve;

a drill assembly including a drill bit; and a mechanism for operatively connecting the drill assembly and outer sleeve.

2. The apparatus of claim 1, wherein the asymmetrically weighted outer sleeve includes at least one sensor.

3. The apparatus of claim 2, wherein the sensor is an orientation sensor that detects the relative position of a marker disposed on the drill assembly.

4. The apparatus of claim 1, wherein the drill assembly includes at least one sensor.

5. The apparatus of claim 4, wherein the sensor is an orientation sensor that detects the relative position of a marker disposed on the asymmetrically weighted outer sleeve.

6. The apparatus of claim 1, wherein the asymmetrically weighted outer sleeve includes at least one recess for at least one bearing.

7. The apparatus of claim 1, wherein the rotational element includes at least one recess for at least one bearing.

8. The apparatus of claim 1, wherein the asymmetrically weighted outer sleeve includes at least one antirotational element.

9. The apparatus of claim 1, wherein the drill assembly includes at least one antirotational element.

10. A method of orienting a drill bit, comprising:

determining an orientation of a drill assembly operatively connected to a drill string and including a drill bit; and reversibly engaging a clutch to a rotating element so that a desired amount of rotational energy is transmitted to the drill assembly.

11. The method according to claim 10, further comprising repeating the determining and reversibly engaging until a desired orientation of the drill bit is achieved.

12. The method according to claim 11, further comprising maintaining the desired orientation by activating at least one antirotational element.

13. The method according to claim 12, wherein the maintaining further comprises reversibly engaging an asymmetrically weighted outer sleeve to the drill assembly in order to limit the rotational freedom of the drill assembly due to the effect of gravity on the orientation of the asymmetrically weighted outer sleeve.

14. The method according to claim 10, wherein the determining further comprises using a sensor disposed on an asymmetrically weighted outer sleeve to detect the relative position of a marker disposed on the drill assembly.

15. The method according to claim 10, wherein the determining further comprises using a sensor disposed on the drill assembly to detect the relative position of the drill assembly with respect to an asymmetrically weighted outer sleeve.

16. A method of orienting a drill bit, comprising:

reversibly engaging a clutch to a rotating element so that a desired amount of rotational energy is transmitted from a rotating drill string to a drill assembly including a drill bit;

determining an orientation of the drill assembly; and repeating the reversibly engaging and the determining until a desired orientation of the drill assembly is achieved.

* * * * *